United States Patent [19]

Young et al.

[11] 3,944,374

[45] Mar. 16, 1976

[54] LOOSE LEAF BINDER

[75] Inventors: Raymond R. Young, Des Plaines; Jack H. Michaelis, Elmhurst, both of Ill.

[73] Assignee: Swingline, Inc., New York, N.Y.

[22] Filed: Aug. 16, 1973

[21] Appl. No.: 388,937

[52] U.S. Cl. ..... 402/33; 402/76; 402/80 R

[51] Int. Cl.[2] ..... B42F 3/04

[58] Field of Search ..... 402/31, 32, 33, 80 R, 75, 402/76, 77

[56] References Cited

UNITED STATES PATENTS

| | | | |
|---|---|---|---|
| 1,667,744 | 5/1928 | Skiles | 402/33 |
| 1,732,584 | 10/1929 | Newman | 402/33 |
| 2,056,801 | 8/1936 | Nelson | 402/33 X |

FOREIGN PATENTS OR APPLICATIONS

| | | | |
|---|---|---|---|
| 1,138,505 | 1/1969 | United Kingdom | 402/31 |
| 1,219,440 | 6/1966 | Germany | 402/33 |
| 1,104,022 | 2/1968 | United Kingdom | 402/31 |
| 1,228,586 | 4/1971 | United Kingdom | 402/36 |
| 1,325,595 | 3/1963 | France | 402/80 R |

*Primary Examiner*—Jerome Schnall
*Attorney, Agent, or Firm*—Pennie & Edmonds

[57] ABSTRACT

A loose leaf binder comprising a backbone having two hinged halves and a flexible displaceable end portion, a flexible displaceable arm linkage mounted on said backbone so that the backbone end portion and linkage cooperate in engaging and disengaging relationship to form multiple positions of the binder including fully opened and fully closed. The binder is capable of being opened by applying opposing forces to the backbone halves and displacing forces to the arm linkage or by applying forces to the backbone halves alone.

1 Claim, 12 Drawing Figures

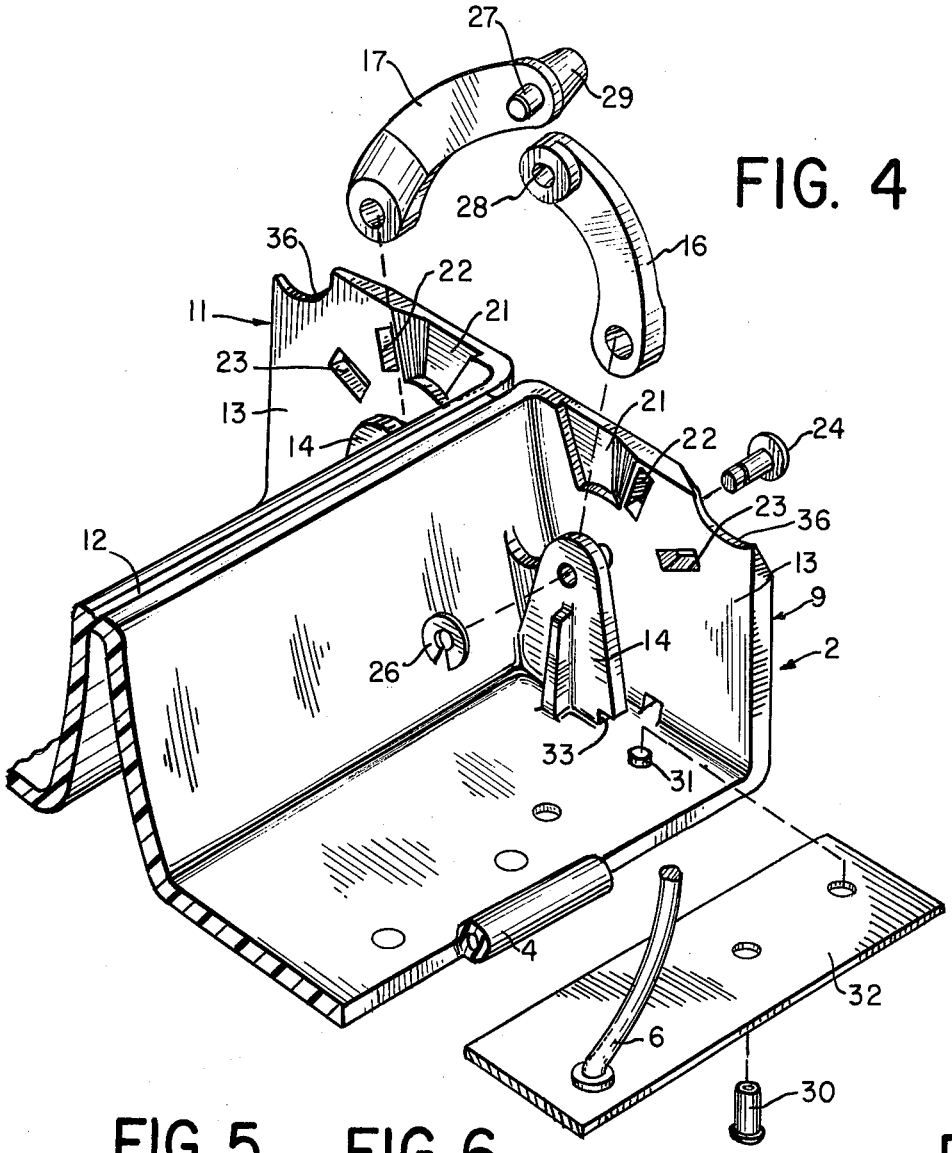
FIG. 4
FIG. 5
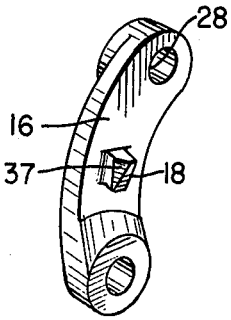
FIG. 6
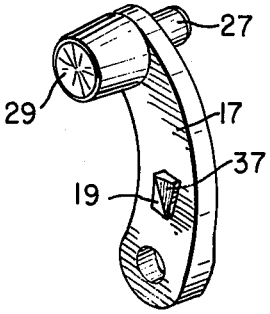
FIG. 7
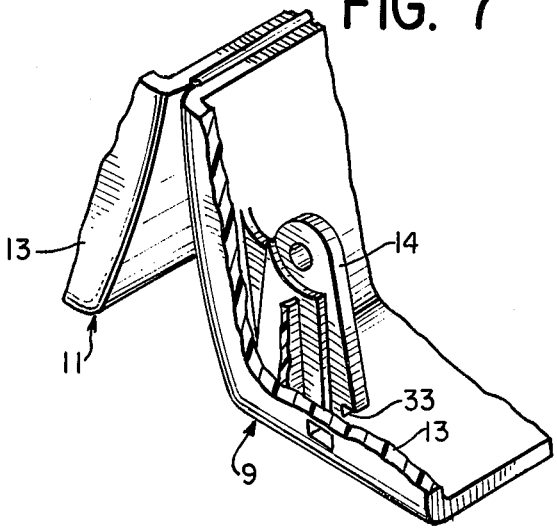

LOOSE LEAF BINDER

BACKGROUND OF THE INVENTION

Loose leaf binders capable of holding a large number of loose leaf pages and positionable on a table or other reading surface so that the pages are disposed at a convenient reading angle have been used for many years. Binders of this type must be readily opened and closed to insert and remove loose leaf pages. United States Pat. No. 1,732,584 discloses such a binder.

Multiple position binders previously manufactured have required a plurality of parts to permit the two piece backbone to be pivotably opened and held in the selected positions. Prior binders have been made of metal parts which were rigid and unyielding, requiring mounting arrangements and spring means to permit parts to be urged toward one another while at the same time being capable of temporary displacement one from the other. The number, shape and function of the binder mechanism parts have required expensive fabrication and assembly costs. The present invention substantially reduces the number of parts required by providing parts which perform multiple functions singly and in cooperation with other parts.

The demand for a more simply constructed binder which can be more easily opened and which is less subject to damage has existed for some time.

SUMMARY OF THE INVENTION

Broadly, the present invention is a loose leaf binder having a backbone with flexible displaceable end elements which include a plurality of lug-receiving recesses and a flexible displaceable lug carrying arm linkage attached to the backbone. The linkage and end elements are shaped and positioned to cooperate with one another to permit the lugs and lug-receiving recesses to hold the binder in a plurality of positions and to be moved to selected positions with a minimum of force and manipulation.

It is a feature of this invention that the arm linkage consists of two flexible bendable arms each pivotably mounted at one end on the backbone and pivotably connected together at the other end, the arms being shaped, sized and mounted to be readily displaced a distance to permit the lugs to be engaged and disengaged from the recesses of the backbone ends.

It is also a feature that the backbone has a L-shaped elements that are integrally formed as a unitary section with a reduced longitudinal groove providing a flexible hinge between them. Preferably, the backbone end elements are also integrally formed as one unit with the rest of the backbone.

It is a further feature that the end portions of the backbone are flexible and deformable to assist in the cooperation of the lugs and recesses. The flexibility of the backbone and arm linkages gives the binder a resilience such that if the binder is dropped it will snap open or close rather than bend or break a binder mechanism part.

BRIEF DESCRIPTION OF THE DRAWINGS

FIG. 4 is a partial perspective view of the end portion of the binder backbone and prong plate. FIGS. 5 and 6 are perspective views of a pair of linkage arms.

FIG. 7 is a partial cut-away perspective view of the backbone including details of an arm bracket.

DESCRIPTION OF THE PREFERRED EMBODIMENT

Figure 1:
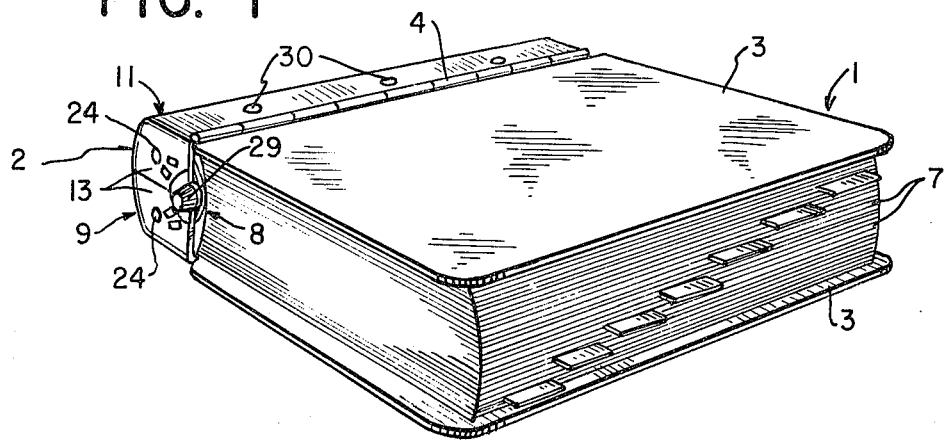
FIG. 1 is a perspective view of a three-position loose leaf binder assembly.
Figure 2:
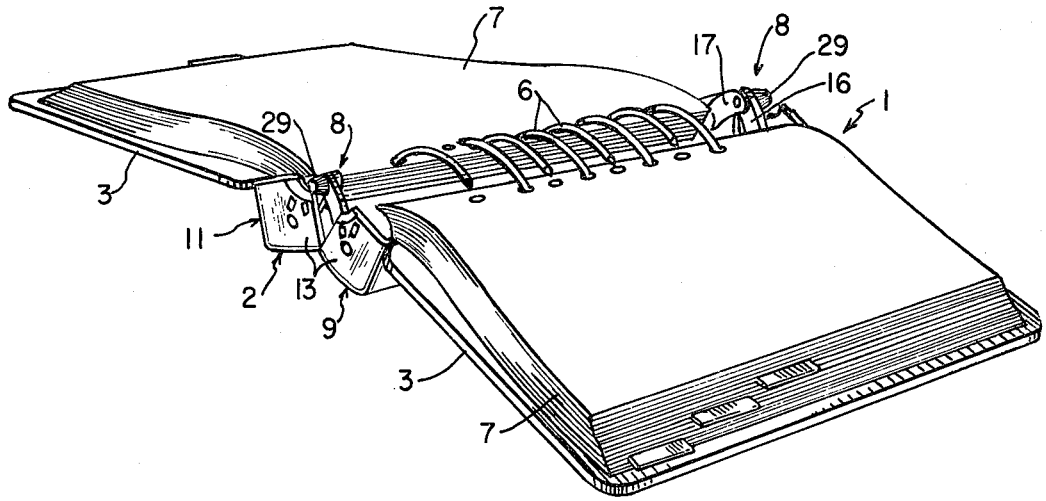
FIG. 2 shows the binder in an open position with the backbone partially separated for reading.
Figure 3:
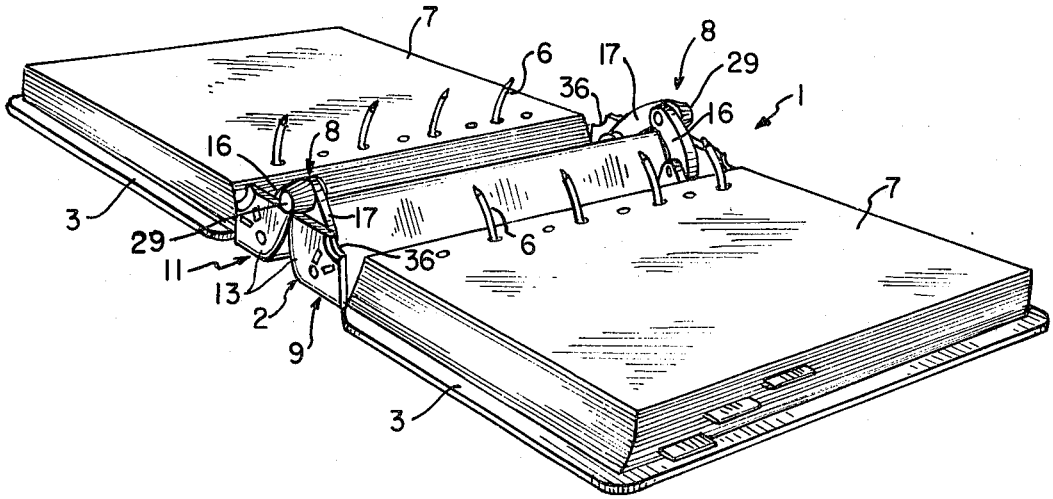
FIG. 3 shows the binder further opened for sheet removal and insertion.

Referring to FIGS. 1-3, loose leaf binder 1 includes hinged backbone 2 and covers 3 connected to the backbone through hinges 4. Arched prongs 6 hold loose leaf pages 7. Backbone positioning arm linkage arrangements 8 permit the backbone 2 to be placed and held in three distinctive positions; closed (FIG. 1), reading position (FIG. 2) and fully opened for page insertion and removal (FIG. 3). The linkage arrangement 8, its mounting in the backbone and the backbone end design are in this embodiment the same at each end of the binder.

Turning to FIGS. 4–7, the backbone positioning arrangement 8 is constructed of particularly shaped parts made from materials and mounted to permit flexing and displacement under the pressures applied by the person handling the loose leaf book to readily permit the opening and closing of the book to the various positions. Preferably, the backbone and arm linkages are made of molded plastic. Backbone 2 includes two L-shaped halves 9 and 11 which are connected together by hinge 12 and includes flexible displaceable backbone ends 13. The backbone is preferably formed as a unit using a material which in the thicknesses and lengths used has a flexibility to permit functioning as herein described.

Adjacent to the backbone ends 13, are brackets 14 which pivotably carry linkage arms 16 and 17 which arms in turn include lugs 18 and 19, respectively, positioned to ride in backbone end recesses 21 when the binder is fully opened for page insertion and removal. Lugs 18 and 19 are positioned in reading-position recess holes 22 when the binder is in the reading position and in closed-position recess holes 23 when the binder is closed.

Directing further attention to FIGS. 4–7, arms 16 and 17 are pivotably connected to brackets 14 through bolts 24 and lock washers 26. The other ends of arms 16 and 17 are pivotably connected together through stud 27 which snap fits into opening 28. Button 29 serves to facilitate applying pressure against the assembled arm linkage to assist lugs 18 and 19 into and out of recesses 21, 22 and 23 through the flexing of the linkage 8 including its arms 16 and 17 and the flexing of backbone ends 13.

L-shaped backbone elements 9 and 11 include locating bosses 31 which assist in positioning prong plate 32 during the riveting operation to secure the plate to L-shaped elements 9 and 11. Rivet 30, prong plate 32 and backbone half 9 are shown in an exploded position in FIG. 4. Prong plate 32 may alternatively be shaped to extend into notch 33 in bracket 14 and in recess 34 in end 13.

Figure 8:
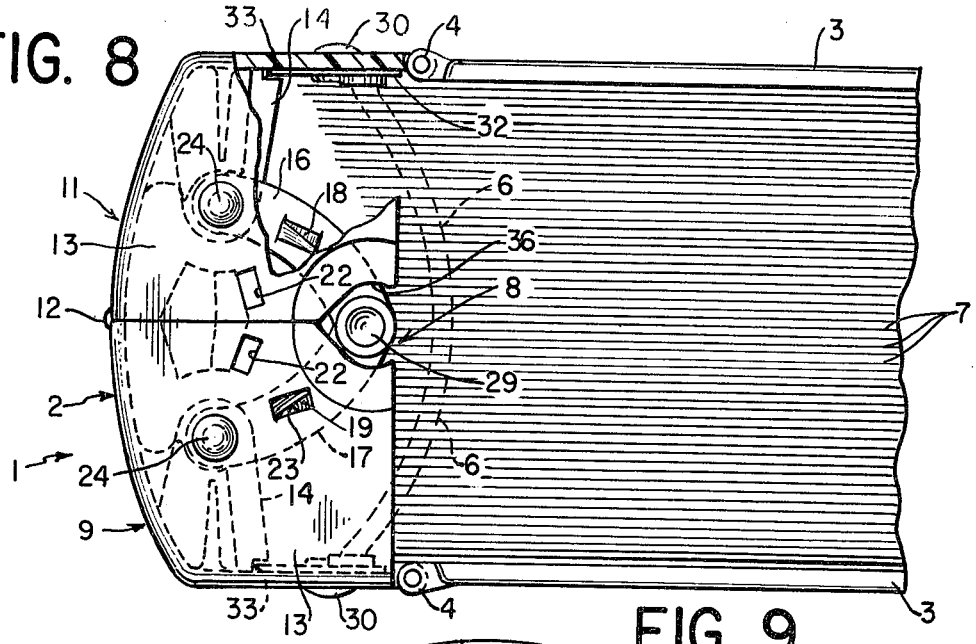
FIGS. 8, 9 and 10 are phantom end views of the binder in the closed, semi-open and fully open positions.
Figure 9:
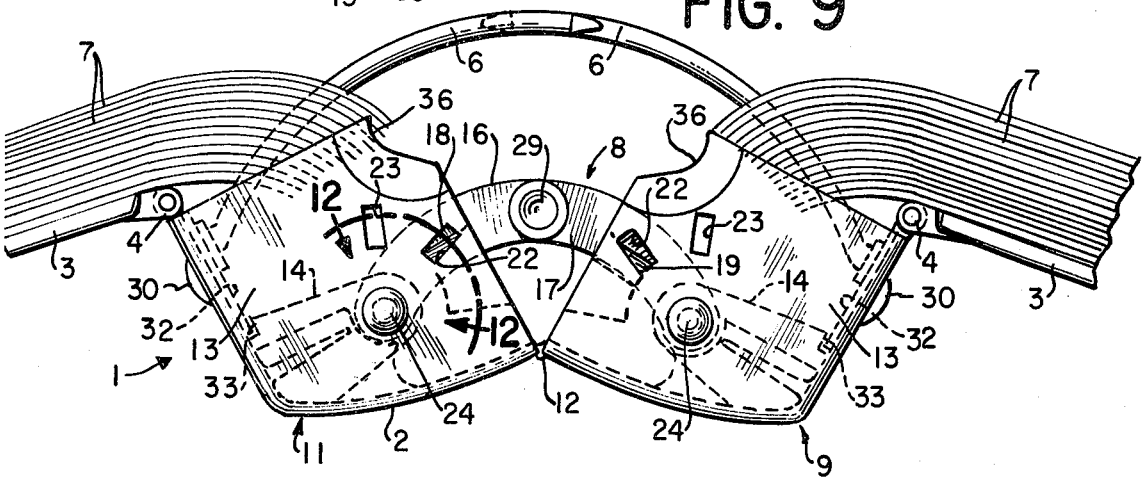

Referring now to FIG. 8, when the binder is in the closed position button 29 protrudes through arcuate openings 36 in ends 13. In this position lugs 18 and 19 are seated in closed-position recess holes 23. To open the binder to the reading positioning (FIG. 9), buttons 29 at each end of the binder may be pushed toward one other end as the L-shaped backbone halves 9 and 11 are urged apart. During this manipulation arms 16 and 17 will be displaced so that lugs 18 and 19 will move out of closed-position recess holes 23. The flexibility of the arm linkage arrangement 8 and backbone ends 13 also permits the binder to be opened by urging the L-shaped halves apart with sufficient force that the lugs will snap out of the recess holes 23. This opening procedure may be accomplished without the operator pushing either of the buttons 29. The binder may be opened until the lugs snap into reading-position holes 22 as shown in FIG. 9.

Figure 10:
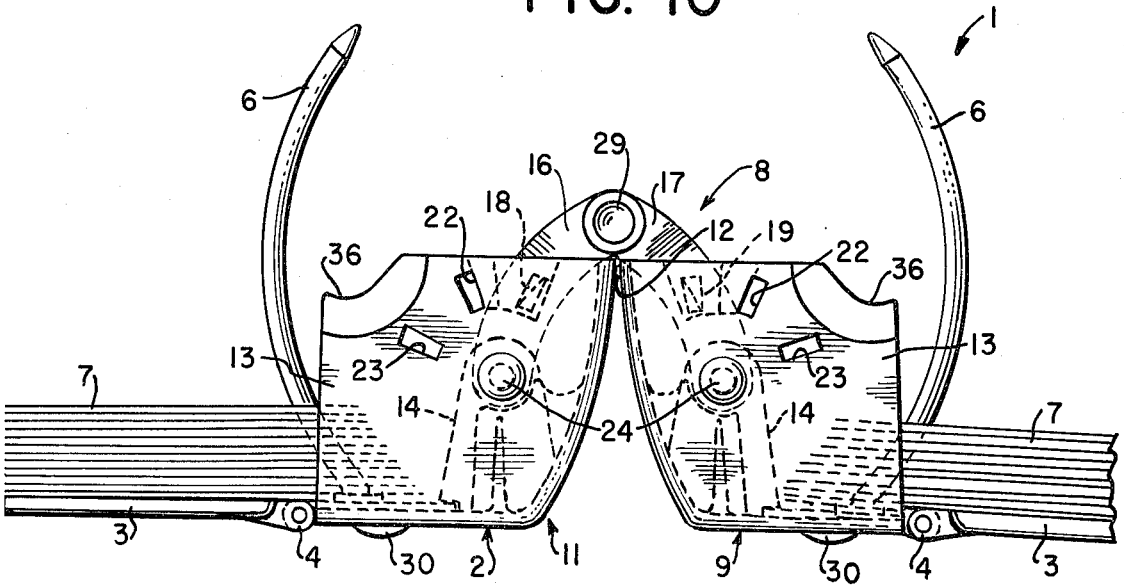
Figure 11:
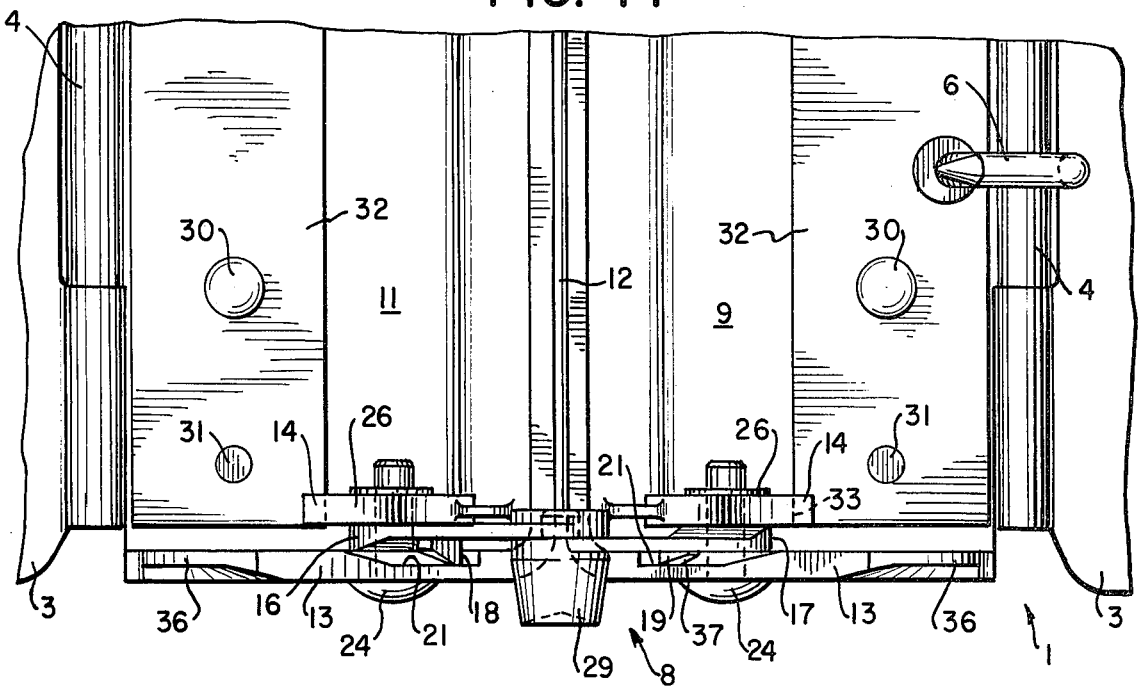
FIG. 11 is an partial elevational view of the open binder and FIG. 12 is a sectional view along line 12—12 of FIG. 9 showing a cammed lug and its operational relation with a recess hole.
Figure 12:
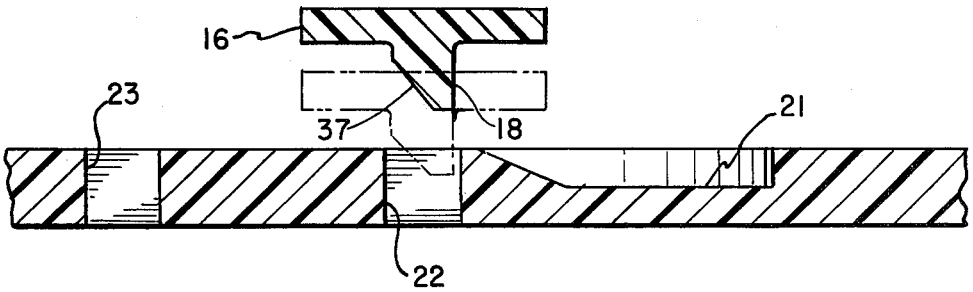

When pages are to be inserted or removed, the binder is further opened by urging L-shaped halves apart with or without applying pressure to buttons 29 to reach the fully opened position (FIG. 10) in which the lugs ride in end recesses 21 which are substantially larger than lug-recess holes 18 and 19 permitting the backbone halves 9 and 11 to be moved relative one to the other as the lugs move back and forth in recesses 21. Closing the binder requires less force than opening the binder since the lugs have cam surfaces 37 (FIG. 12) which are positioned and angled to permit the lugs to readily ride out of the recesses 21 and 22 during closing.

We claim:

1. In a loose leaf binder having a backbone including two hinged together L-Shaped halves having integral end portions, covers hinged to the backbone, a linkage arrangement mounted on the backbone and cooperating therewith to permit the backbone to be placed in and held in a multiplicity of positions the improvement comprising:

a. at least one linkage arrangement having two flexible arms each pivotably mounted at one end to an L-shaped backbone half adjacent to a flexible displaceable end portion thereof with the other ends of the arms being pivotably connected together;

b. lug means positioned on each of said flexible arms;

c. said adjacent end portions each having at least three lug-receiving recesses disposed radially away from the hinged portion of the respective L-shaped backbone halves, said recesses comprising:

1. a first recess immediately adjacent said hinged portion which is of an area substantially larger than the area of said lug means and is of a depth less than the length of said lug means and having the side farthest from said hinge portion sloping to essentially zero depth;

2. a second recess adjacent said first recess which is of an area only slightly larger than the area of said lug means and is of a depth approximately equal to or greater than the length of said lug means; and 3. at least one additional recess similar in area and depth to said second recess;

d. said lug means cooperating with the first recess, the second recess, and the additional recess, whereby the closing of said backbone halves causes said lug means to move from said first recess into said second recess so that the binder is held open in one position and further closing of said backbone halves to cause said lug means to move to said additional recess to that the binder is held in a closed position, e. said lug means having an angled cam surface to assist in the separation of the lug means from the lug receiving recess during closing of the binder, f. said linkage arrangement and said end portions being readily displaced toward and away from one another by displacement, deformation and flexing of the binder due to forces applied to the linkage arrangement and backbone halves either intentionally or accidentally, and g. said backbone including the L-shaped halves and end portions being formed integrally of plastic material.

* * * * *